US012680398B1

(12) United States Patent
McManus et al.

(10) Patent No.: US 12,680,398 B1
(45) Date of Patent: Jul. 14, 2026

(54) SUBSYSTEM WITH A LOCKING RING FOR COUPLING COMPONENTS IN A WELLBORE

(71) Applicant: Halliburton Energy Services, Inc., Houston, TX (US)

(72) Inventors: David McManus, Tulsa, OK (US); Ankit Kansagra, Vadodara (IN); Daniel Steven McWherter, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/210,357

(22) Filed: May 16, 2025

(51) Int. Cl.
*E21B 17/046* (2006.01)

(52) U.S. Cl.
CPC ..... *E21B 17/046* (2013.01)

(58) Field of Classification Search
CPC ..... E21B 17/04; E21B 17/041; E21B 17/046; E21B 17/0465; E21B 17/08; E21B 17/085; F16L 37/24; F16L 37/244; F16L 37/2445; F16L 37/248; F16L 37/252
See application file for complete search history.

(56) References Cited

U.S. PATENT DOCUMENTS 1,128,634 A * 2/1915 Talbot ..... E21B 17/08 285/91
1,386,210 A * 8/1921 Thomas ..... F16L 37/252 285/376
1,818,261 A * 8/1931 Koch ..... F16B 7/00 403/349
1,896,104 A * 2/1933 Simmons ..... E21B 43/10 166/287
3,922,009 A * 11/1975 Giebeler ..... E21B 17/08 285/391
4,209,191 A * 6/1980 Lawson ..... E21B 17/08 285/376
4,260,180 A * 4/1981 Halushka ..... F16L 37/2445 285/391
4,261,599 A 4/1981 Streed
(Continued)

FOREIGN PATENT DOCUMENTS

WO WO-2013119667 A1 * 8/2013 ..... F16L 37/2445
WO WO-2016126508 A1 * 8/2016 ..... F16L 37/244

OTHER PUBLICATIONS

International Patent Application No. PCT/US2025/032193, International Search Report and Written Opinion mailed Feb. 10, 2026, 11 pages.

*Primary Examiner* — Jennifer H Gay
(74) *Attorney, Agent, or Firm* — Kilpatrick Townsend & Stockton LLP

(57) ABSTRACT

A system can include a subsystem with a first component having a set of tabs and a second component having a set of slots. The set of tabs can extend to a diameter larger than that of a first connector of the first component. The set of slots can extend to a diameter larger than that of a second connector of the second component. The set of tabs can be positioned through the set of slots and can be rotated to axially align the set of tabs with another set of tabs of the second component. The subsystem can include a locking ring that can be positioned around the first connector and can be inserted into the set of slots to prevent rotation and disengagement of the tabs.

20 Claims, 8 Drawing Sheets

(56) References Cited

U.S. PATENT DOCUMENTS

| | | | | |
|---|---|---|---|---|
| 4,406,485 | A * | 9/1983 | Giebeler | E21B 43/26 285/391 |
| 4,878,695 | A * | 11/1989 | Whitham | F16L 37/252 403/348 |
| 5,403,043 | A * | 4/1995 | Smet | E21B 17/0423 285/391 |
| 6,257,792 | B1 * | 7/2001 | Read, Jr. | F16D 1/116 166/242.6 |
| 9,745,802 | B2 * | 8/2017 | Morrison | E21B 17/046 |
| 9,816,563 | B2 * | 11/2017 | Gharib | F16D 1/112 |
| 10,526,852 | B2 * | 1/2020 | Wiens | E21B 17/023 |
| 10,605,012 | B2 * | 3/2020 | Loose-Mitchell | E21B 17/043 |
| 10,822,887 | B2 * | 11/2020 | Persent | E21B 17/085 |
| 10,995,891 | B2 * | 5/2021 | Kozicz | F16L 37/252 |
| 11,499,376 | B2 * | 11/2022 | Charland | E21B 10/62 |
| 12,421,809 | B2 * | 9/2025 | Eitschberger | E21B 43/119 |
| 2007/0254516 | A1 * | 11/2007 | Stoetzer | E21B 17/046 439/320 |
| 2012/0267214 | A1 * | 10/2012 | Gabriel | F16L 37/2445 285/376 |
| 2013/0207382 | A1 * | 8/2013 | Robichaux | F16L 23/18 285/95 |
| 2015/0083396 | A1 | 3/2015 | Linklater et al. | |
| 2016/0222738 | A1 * | 8/2016 | Morrison | E21B 17/046 |
| 2017/0058606 | A1 | 3/2017 | Gharib et al. | |
| 2017/0089399 | A1 * | 3/2017 | Gharib | E21B 4/02 |
| 2017/0241213 | A1 * | 8/2017 | Boswell | E21B 17/046 |
| 2017/0328138 | A1 * | 11/2017 | Loose-Mitchell | E21B 17/043 |
| 2018/0171724 | A1 | 6/2018 | Daigle et al. | |
| 2018/0363388 | A1 * | 12/2018 | Wiens | E21B 17/046 |
| 2019/0136642 | A1 * | 5/2019 | Persent | E21B 17/046 |
| 2021/0131191 | A1 * | 5/2021 | Charland | E21B 10/32 |
| 2021/0372551 | A1 * | 12/2021 | Clark | A61M 5/50 |
| 2024/0209696 | A1 * | 6/2024 | Eitschberger | E21B 43/119 |
| 2025/0389162 | A1 * | 12/2025 | Newport | E21B 17/046 |

* cited by examiner

SUBSYSTEM WITH A LOCKING RING FOR COUPLING COMPONENTS IN A WELLBORE

TECHNICAL FIELD

The present disclosure relates generally to wellbore operations and, more particularly (although not necessarily exclusively), to a locking ring that can be used to couple components of a subsystem that can be positioned in a wellbore.

BACKGROUND

Wellbore operations may include various equipment, components, methods, or techniques to perform various tasks, such as fluid control, with respect to a wellbore. In some examples, the wellbore operations may involve using a downhole pump such as an electric submersible pump to control fluid flow with respect to the wellbore. The downhole pump can be positioned downhole in the wellbore to perform a subset of the wellbore operations. In some examples, the downhole pump can include multiple components. Maintaining the connection of the multiple components in the subsystem in the wellbore can be difficult over the lifespan of the equipment.

DETAILED DESCRIPTION

Figure 1:
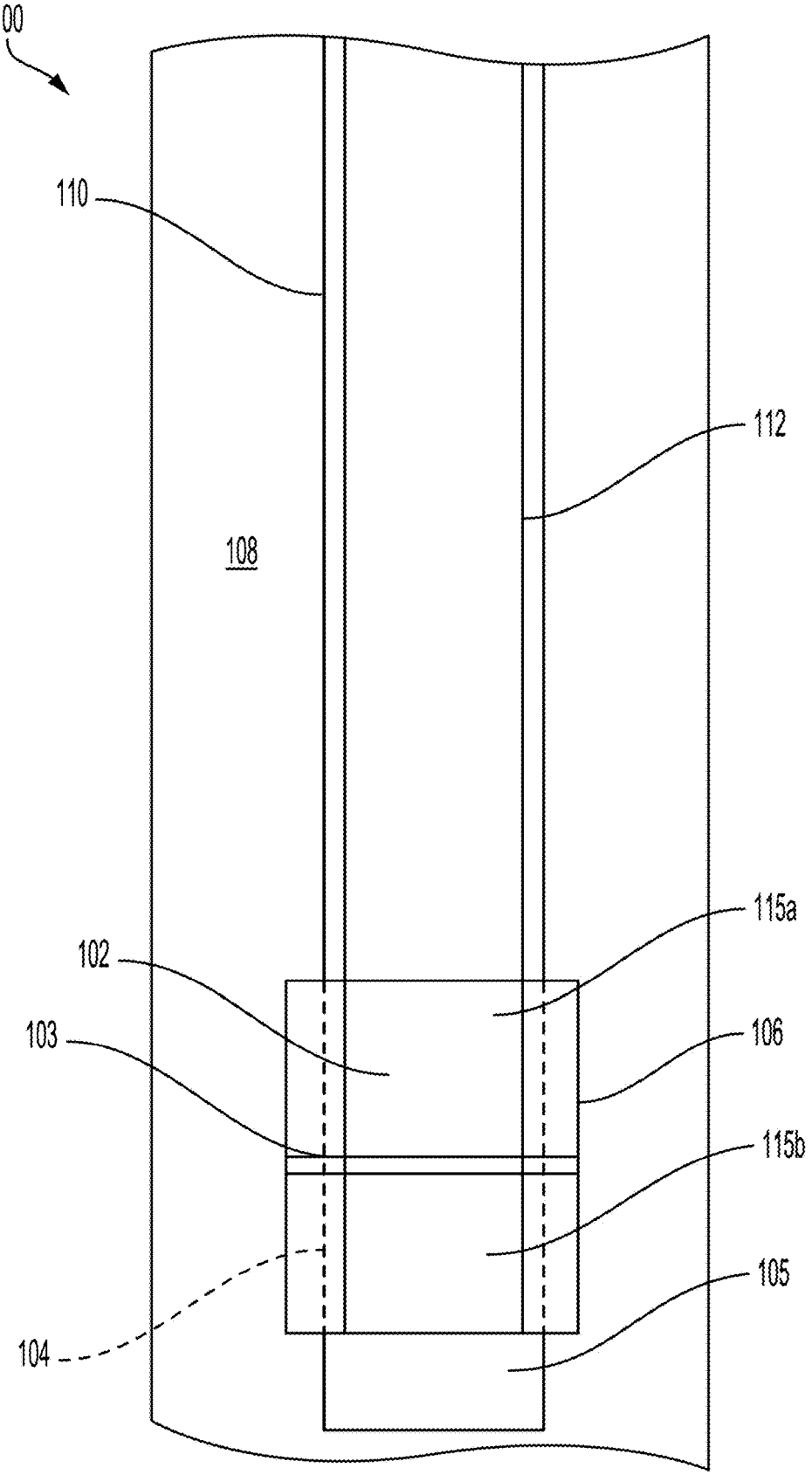
FIG. 1 is a diagram of a well system that can include a subsystem, such as a downhole pump, that can include a locking ring according to some aspects of the present disclosure.

Certain aspects and examples of the present disclosure relate to a locking ring that can be used to couple components of a subsystem that can be positioned in a wellbore of a well system. The wellbore may be formed in a subterranean formation or a suboceanic formation for extracting material such as hydrocarbon material, water, brine, or the like. The subsystem can be positioned in the wellbore to perform or facilitate one or more wellbore operations in the wellbore or one or more other operations in the well system. For example, the subsystem can be or include an electric submersible pump (ESP) or other downhole tool that can perform the one or more wellbore operations or the one or more other operations. In some examples, the ESP can pump fluid with respect to the wellbore. The subsystem can include the components that can include more than one component. For example, the subsystem can include a motor, a centrifugal pump, one or more connectors, and the like. The components may be coupled using the locking ring. Coupling the components using the locking ring can involve positioning the locking ring within a connection point between two or more components to lock a position of the two or more components, to lock an alignment of the two or more components, or a combination thereof.

In some examples, an ESP can be used in a well system for artificial lift applications or other suitable applications. The ESP can include multiple components, which can be connected together to form, or to provide functionality for, the ESP. Other ESPs can involve connecting components by using various bolts. The bolts can experience a failure such as via excessive tensile load, vibration, exposure to harsh fluid, etc. In examples in which the various bolts fail in other systems, the other systems can involve dropped equipment, operations to retrieve the dropped equipment from the wellbore, operation delays, damage to the wellbore, the ESP, or other tools in the wellbore, etc. Additionally or alternatively, acquiring high strength grade materials may involve excessive resources or time delays.

A subsystem, such as the subsystem disclosed herein, can use the locking ring to obviate the bolts and to reduce potential failure modes in the subsystem. In some examples, the subsystem can be a boltless design for enhancing ESP performance in a wellbore. By using the locking ring, such as instead of a set of bolts, the subsystem can prevent or reduce instances of failures and equipment droppage in the wellbore.

The subsystem can include a first component and a second component that can include tabs, slots, or a combination thereof. For example, the first component can be a male component that can include a set of tabs that may include one or more tabs extending outward from an outer diameter of a connection surface of the first component, and the second component can be a female component that can include a set of slots that may include one or more slots extending inward from an inner diameter of a connection surface of the second component. The set of tabs can be inserted through the set of slots, and the first component can be rotated to at least approximately axially align, or misalign, the set of tabs with the set of slots to provide axial support in the subsystem. Upon rotation, one or more aligned gaps can be formed in the subsystem, and the locking ring can be positioned in at least one aligned gap of the one or more aligned gaps. For example, the locking ring can include one or more protrusions, such as keys, that can be positioned in corresponding aligned gaps of the one or more aligned gaps. Once positioned in the one or more aligned gaps, the locking ring may retain a coupling and alignment between the first component and the second component by preventing relative rotation between the first component and the second component. In some examples, a retention mechanism can be added to, or coupled with, the locking ring to retain the locking ring in place.

In examples in which the subsystem is an ESP or an otherwise submersible device in a wellbore, the subsystem can include teeth, such as tabs and slots, on an upstream component, on a downstream component, or a combination thereof. The tabs and slots can allow the upstream component and the downstream component to be locked together with the locking ring upon assembly and rotation of the upstream component and the downstream component relative to one another. In some examples, a gap filler ring can be used as a retention mechanism to block movement of the locking ring or otherwise retain the locking ring in place in the subsystem. Other suitable examples of retention mechanisms, such as set screws, L-brackets, threaded collars, etc., are possible.

The subsystem can include a first component, a second component, and a locking ring. In some examples, the first component can include an upper component, or an upstream component, with respect to a connection point in the subsystem. Additionally or alternatively, the second component can include a lower component, or a downstream component, with respect to the connection point in the subsystem. The first component can include a first connection surface, such as a base, that can include outwardly projecting tabs and inwardly projecting slots that alternate with respect to one another. That is, the tabs of the first component can have an outer diameter that is larger than a different outer diameter of the first connection surface, or of the inwardly projecting slots, to form peaks and valleys on the first connection surface. Additionally or alternatively, the second component can include a second connection surface, such as a head, that can include outwardly projecting tabs and inwardly projecting slots alternating with respect to one another. That is, the slots of the second component can have an inner diameter that is larger than a different outer diameter of the second connection surface, or of the outwardly projecting tabs, to form peaks and valleys on the second connection surface. The peaks and valleys of the first connection surface may correspond with the peaks and valleys of the second connection surface.

The subsystem can additionally include the locking ring for coupling the first component and the second component. In some examples, the locking ring can include integral keys that may correspond with the peaks and valleys of the first connection surface, of the second connection surface, or of a combination thereof. For example, when the first component is connected with the second component and is rotated relative to the second component, a set of aligned gaps can form at a connection point of the first component and the second component. The set of aligned gaps can include a number of gaps that is similar or identical to, or otherwise consistent with, a number of integral keys or protrusions included in the locking ring. That is, the locking ring, or the integral keys or protrusions thereof, can be positioned in the set of aligned gaps to lock the first component and the second component in place after being connected and rotated.

In some examples, coupling the first component and the second component can involve positioning the first component into the second component by sliding the tabs of the first component through the slots of the second component. Additionally or alternatively, coupling the first component and the second component can involve rotating the first component relative to the second component, or vice versa, to axially align, or axially misalign, the tabs and slots for providing axial support in the subsystem. For example, the first component can be rotated relative to the second component, or vice versa, to axially align a first set of tabs of the first component with a second set of tabs of the second component. In response to rotating the first component relative to the second component, or vice versa, the set of aligned gaps may be presented or otherwise accessible, and the locking ring, or any subset of the locking ring, can be positioned in the aligned gaps to lock the first component and the second component in place. Locking the first component and the second component in place can involve using the locking ring to retain an alignment, a position, or a combination thereof of the first component relative to the second component. Additionally or alternatively, locking the first component and the second component in place can involve using the locking ring to prevent (i) rotation of the first component relative to the second component, or vice versa, and (ii) disengagement of the first component from the second component, or vice versa.

In some examples, the subsystem can additionally include a retention mechanism that can retain the locking ring in place, for example in the set of aligned gaps. The retention mechanism can include a gap filler clamp, one or more set screws, an L-bracket, a threaded collar, other suitable retention mechanisms, or any combination thereof. The gap filler clamp can block movement of the locking ring once inserted into the set of aligned gaps. One or more screws or other mechanical retention means can be used to hold the gap filler clamp together. The one or more set screws can be positioned in one or more threaded holes on a collar of the locking ring to press against the first connection surface or the second connection surface to retain the locking ring in place. The L-bracket or the threaded collar can be positioned around the locking ring and secured with one or more set screws, or secured via threading, to retain the locking ring in place.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure. As used herein, approximately indicates that a recited value may vary, such as above or below, by 1%, 2%, 3%, 4%, 5%, from 5% to 10%, from 10% to 20%, and the like.

FIG. 1 is a diagram of a well system 100 that can include a subsystem 102, such as a downhole pump or electric submersible pump (ESP), that can include a locking ring 103 according to some aspects of the present disclosure. In some examples, the subsystem 102 can be, can include, or can be included in an ESP system, which may include a motor, seal, pump, intake, gas separator, and sensor section. The subsystem 102 can be encapsulated within a housing 106, such as a motor housing, that can be positioned within the wellbore 108. The subsystem 102 may facilitate various wellbore operations such as fluid pumping or other suitable wellbore operations. An auxiliary unit 105, such as a bellows or a seal unit or other suitable auxiliary device or unit, may be attached to the subsystem 102, such as on a downhole side of the subsystem 102, though other examples may be possible. In some examples, the auxiliary unit 105 may be omitted or may be otherwise suitably positioned in the well system 100 to facilitate operation of the subsystem 102.

The well system 100 may include a flow path 104 that can be defined through a central axis of the subsystem 102 or any subset or component thereof. The flow path 104 may serve as a conduit for directing fluids, such as well fluids or produced material, such as produced hydrocarbons, from the subsystem 102 into connected tubing 110. The design of the flow path 104 may be engineered or otherwise adjusted to promote controlled and continuous fluid movement, which can help maintain consistent pressure and flow rates within the well system 100. The flow path 104 may be carefully aligned with the internal components of the subsystem 102 to minimize disruptions and to facilitate smooth and uninterrupted fluid transfer. The connected tubing 110 may be positioned around an exterior of the well system 100, or suitable components thereof, and can operate to contain and guide the fluid flow within the wellbore 108. For example, the connected tubing 110 may direct fluids to and from the subsystem 102 while isolating the well system 100 from surrounding geological formations. Additionally or alternatively, the connected tubing 110 can provide structural support to ensure that the internal components of the well system 100 remain centered and properly aligned with respect to one another and within the wellbore 108.

A flow tube 112 may also be included within the well system 100. The flow tube 112 can be positioned within an interior region of the subsystem 102, an interior region of the connected tubing 110, or a combination thereof, and the flow tube 112 may further direct fluid flow through the subsystem 102 and into subsequent components of the well system 100. In some examples, the flow tube 112 may guide the fluids in an efficient manner, for example to minimize turbulence and to minimize pressure losses as the fluids move downstream. In some examples, the wellbore 108 may provide an outer boundary for the well system 100 and can encompass the subsystem 102, the connected tubing 110, other suitable components, or any combination thereof. The wellbore 108 may also influence the operational environment, such as by subjecting the components to variations in pressure, temperature, and well fluid composition.

In some examples, the subsystem 102 can include multiple components connected by the locking ring 103. The locking ring 103 can be used to couple a first component 115*a* of the subsystem 102 with a second component 115*b* of the subsystem 102. The first component 115*a* may be or include an downstream component, such as a pump, of the subsystem 102, and the second component 115*b* may be or include an upstream component, such as an intake unit or other connecting unit, of the subsystem 102, though other examples of components may be possible for the first component 115*a*, the second component 115*b*, or a combination thereof. The locking ring 103 can be positioned at a connection point between the first component 115*a* and the second component 115*b* to couple the first component 115*a* with the second component 115*b*, for example without using bolts.

Figure 2:
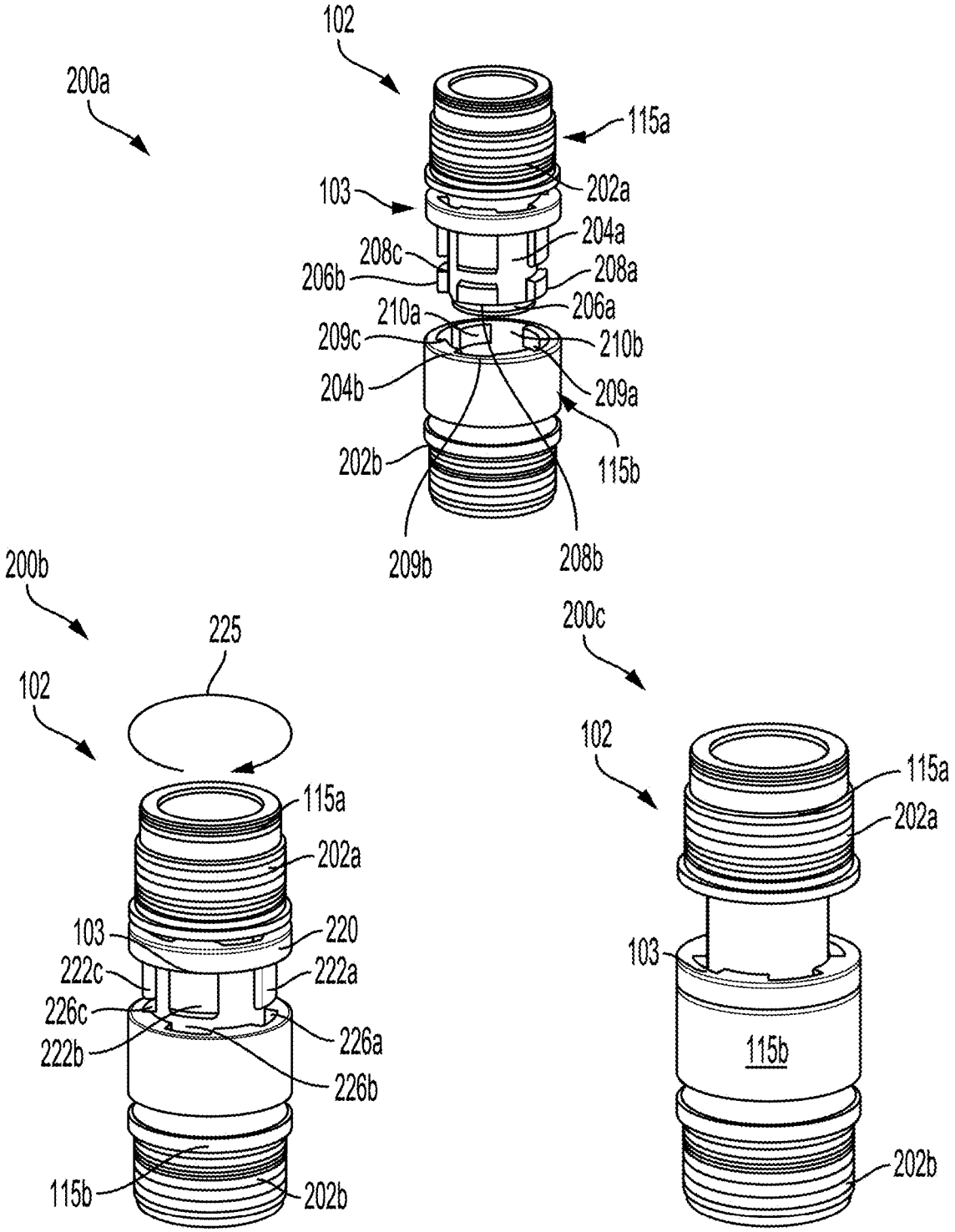
FIG. 2 is a set of views of a subsystem that can include a locking ring for coupling components of the subsystem according to some aspects of the present disclosure.

FIG. 2 is a set of views of a subsystem 102 that can include a locking ring 103 for coupling components of the subsystem 102 according to some aspects of the present disclosure. As illustrated in FIG. 2, the subsystem 102 can include a first component 115*a*, a second component 115*b*, and the locking ring 103, though any additional, alternative, or fewer components are possible to include in the subsystem 102. The set of views in FIG. 2 can include a first view 200*a*, a second view 200*b*, and a third view 200*c*. The first view 200*a* may illustrate a perspective view of the subsystem 102 prior to the first component 115*a* being coupled with the second component 115*b*, the second view 200*b* may illustrate a perspective view of the subsystem 102 after connecting the first component 115*a* with the second component 115*b* but before coupling via implementing the locking ring 103, and the third view 200*c* may illustrate a perspective view of the subsystem 102 after coupling the first component 115*a* with the second component 115*b* using the locking ring 103.

As illustrated in FIG. 2, the first component 115*a* can include a first body 202*a* and a first connection surface 204*a* or connector. The first connection surface 204*a* can extend from the first body 202*a* and can have a first outer diameter 206*a*. Additionally or alternatively, the first component 115*a* can include a first set of tabs that can be positioned on or adjacent to the first connection surface 204*a* and can extend outwardly from the first connection surface 204*a*. The first set of tabs can include a first tab 208*a*, a second tab 208*b*, and a third tab 208*c*, though any other suitable number, such as less than three or more than three, of tabs are possible to include in the first set of tabs. Each tab of the first set of tabs may extend to a second outer diameter 206*b* that can be larger than, or that can extend further outward from the first connection surface 204*a*, than the first outer diameter 206*a*. In some examples, slots of a first set of slots may be interwoven, or positioned in an alternating fashion, between tabs of the first set of tabs. The first set of slots may coincide with the first outer diameter 206*a*.

Additionally or alternatively, the second component 115*b* can include a second body 202*b* and a second connection surface 204*b* or connector. The second connection surface 204*b* can extend from the second body 202*b* and can have a first inner diameter 210*a*. Additionally or alternatively, the second component 115*b* can include a second set of slots that be positioned on or adjacent to the second connection surface 204*b* and can extend inwardly, or in other cases outwardly, from the second connection surface 204*b*. The second set of slots can include a first slot 209*a*, a second slot 209*b*, and a third slot 209*c*, though any other suitable number, such as less than three or more than three, of slots are possible to include in the second set of slots. Each slot of the second set of slots may extend further from a central axis of the subsystem 102 than the second connection surface 204*b*, or than any tab included in a second set of tabs of the second component 115*b*. For example, each slot of the second set of slots, or any subset thereof, can have a second inner diameter 210*b* that is larger than the first inner diameter 210*a* that may be associated with the second set of tabs.

As illustrated in FIG. 2, the locking ring 103 can be positioned around the first connection surface 204*a*, though the locking ring 103 can be positioned in any other suitable location with respect to the subsystem 102 for coupling the first component 115*a* and the second component 115*b*. The locking ring 103 can include a collar 220 and a set of keys. The set of keys can include a first key 222*a*, a second key 222*b*, and a third key 222*c*, though any other suitable number, such as less than three or more than three, of keys are possible to include in the set of keys. In some examples, the keys may be or include protrusions that extend from the collar 220. The protrusions may be sized to be positioned in one or more slots of the first set of slots or the second set of slots, to be positioned in one or more gaps formed by aligning the first component 115*a* with the second component 115*b*, etc. Additionally or alternatively, each key of the set of keys, or any subset thereof can be tapered to facilitate coupling between the first component 115*a* and the second component 115*b*.

The first set of tabs, the second set of tabs, the first set of slots, the second set of slots, and the set of keys may each correspond with one another. For example, if the set of keys includes four keys, then the first set of tabs and the second set of tabs can each include four tabs and the first set of slots, and the second set of slots can each include four slots. Other correspondences between the first set of tabs, the second set of tabs, the first set of slots, the second set of slots, and the set of keys are possible. For example, the set of keys may have fewer keys than the first set of tabs includes tabs, than the second set of slots includes slots, or a combination thereof, while being arranged to be used for coupling the first component 115*a* with the second component 115*b*.

As illustrated in FIG. 2, the first component 115*a* can be positioned in the second component 115*b*. For example, the first connection surface 204*a* can be positioned within the second connection surface 204*b*, for example by passing the first set of tabs of the first component 115*a* through the second set of slots of the second component 115*b*. As illustrated in the first view 200*a* and the second view 200*b*, the first set of tabs can be aligned with the second set of slots to allow the first component 115*a* to be inserted into the second component 115*b*. Additionally or alternatively, and as also illustrated in the second view 200*b*, the first component 115*a* can be rotated via rotational motion 225 relative to the second component 115*b* to axially align the first set of tabs and the second set of tabs. In some examples, axially aligning the first set of tabs and the second set of tabs can involve positioning the first set of tabs relative to the second set of tabs to provide axial support in the subsystem 102, such as by causing the first set of tabs to be in contact with the second set of tabs. Additionally or alternatively, axially aligning the first set of tabs and the second set of tabs can involve at least partially misaligning the first set of tabs with the second set of slots to cause the first set of tabs to contact an inner surface of the second connection surface 204*b*, or the second set of tabs, to provide the axial support.

As illustrated in the second view 200*b*, and in response to positioning the first component 115*a* in the second component 115*b* and axially aligning the first set of tabs with the second set of tabs, a set of aligned gaps may be exposed or otherwise accessible. In some examples, the set of aligned gaps may be or include the first set of slots and the second set of slots, or any subset thereof. The set of aligned gaps can include a first aligned gap 226*a*, a second aligned gap 226*b*, and a third aligned gap 226*c*, though any other suitable number, such as less than three or more than three, of aligned gaps are possible to include in the set of aligned gaps. The set of aligned gaps may correspond with the set of keys of the locking ring 103. For example, the set of aligned gaps may include a first number of aligned gaps that is the same as a second number of keys included in the set of keys. The set of keys may include fewer keys than the set of aligned gaps includes aligned gaps.

In some examples, the set of keys may be sized, arranged, or a combination thereof, to be positioned in the set of aligned gaps. As illustrated in the third view 200*c*, the locking ring 103 can be translated towards the second component 115*b* to cause the set of keys of the locking ring 103 to be positioned in the set of aligned gaps. By positioning the set of keys of the locking ring 103 in the set of aligned gaps, the locking ring 103 can couple the first component 115*a* with the second component 115*b*. In some examples, coupling the first component 115*a* with the second component 115*b* can involve retaining a relative position and orientation between the first component 115*a* and the second component 115*b*. That is, when the locking ring 103 is engaged with the set of aligned gaps, the first component 115*a* may not be able to rotate, translate, or a combination thereof relative to the second component 115*b*, or vice versa.

Figure 3:
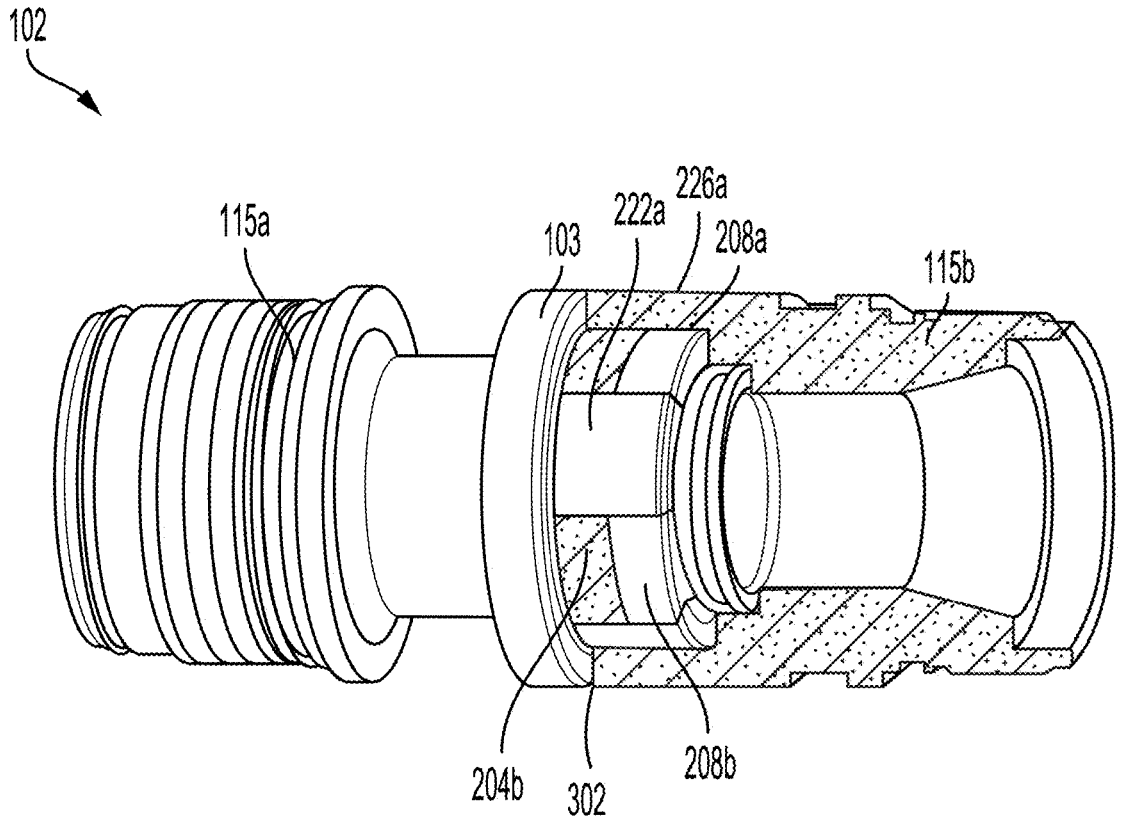
FIG. 3 is a partial sectional view of a subsystem that can include a locking ring for coupling components of the subsystem according to some aspects of the present disclosure.

FIG. 3 is a partial sectional view of a subsystem 102 that can include a locking ring 103 for coupling components of the subsystem 102 according to some aspects of the present disclosure. As illustrated in FIG. 3, the subsystem 102 can include the first component 115*a*, the second component 115*b*, and the locking ring 103. The first component 115*a* may be coupled with the second component 115*b* by engaging the locking ring 103. In some examples, engaging the locking ring 103 can involve positioning the set of keys of the locking ring 103 in the set of aligned gaps formed by axially aligning the first set of tabs of the first component 115*a* with the second set of tabs of the second component 115*b* while the first component 115*a* is positioned in the second component 115*b*.

As illustrated in FIG. 3, the locking ring 103 is engaged to couple the first component 115*a* with the second component 115*b*. For example, the first key 222*a* of the set of keys can be positioned in the first aligned gap 226*a* of the set of aligned gaps. In other examples, the first key 222*a* of the set of keys can be positioned in the first slot 209*a*. Additionally or alternatively, the first key 222*a* can be positioned between the first tab 208*a* of the set of tabs and the second tab 208*b* of the set of tabs, though the first key 222*a* can be positioned between other suitable pairs of tabs of the set of tabs. By positioning the first key 222*a*, or other suitable keys, between a pair of tabs, the locking ring 103 can prevent relative rotation between the first component 115*a* and the second component 115*b*. Additionally or alternatively, by the first tab 208*a* and the second tab 208*b* being axially aligned with corresponding slots of the second set of slots, the first tab 208*a* and the second tab 208*b* can contact an inner surface 302 of the second connection surface 204*b*, or of corresponding tabs of the second set of tabs, to provide axial support in the subsystem 102.

Figure 4:
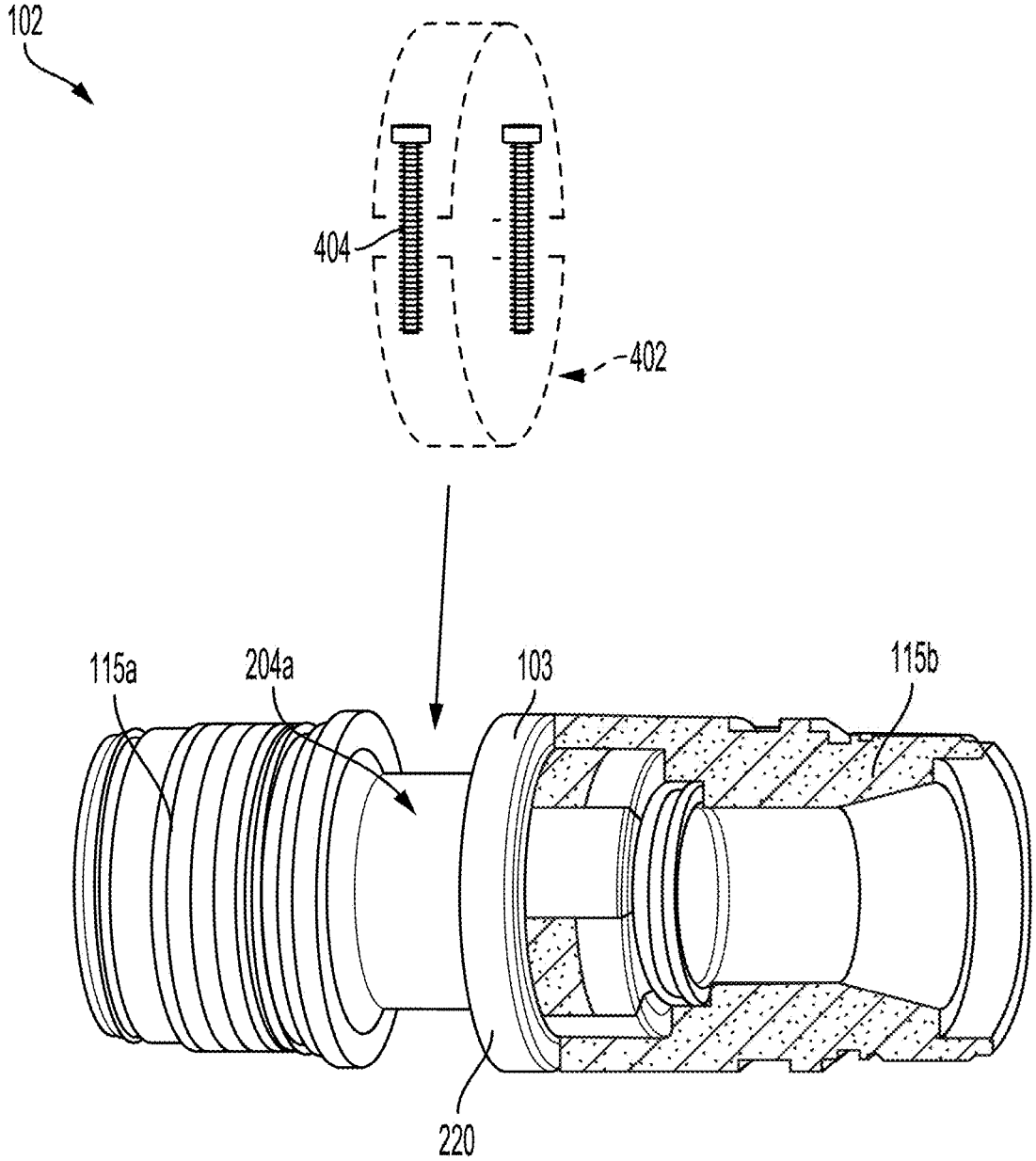
FIG. 4 is a partial sectional view of a subsystem that can include a locking ring with a first retention mechanism for coupling components of the subsystem according to some aspects of the present disclosure.

FIG. 4 is a partial sectional view of a subsystem 102 that can include a locking ring 103 with a first retention mechanism 402 for coupling components of the subsystem 102 according to some aspects of the present disclosure. As illustrated in FIG. 4, the subsystem 102 can include the first component 115*a*, the second component 115*b*, and the locking ring 103, though the subsystem 102 can include any additional, alternative, or fewer components for providing functionality for the subsystem 102. The locking ring 103 can be used to couple the first component 115*a* with the second component 115*b*. For example, the set of keys can be positioned in the set of aligned gaps, or the set of first slots or the set of second slots, to prevent the first component 115*a* from rotating, translating, or a combination thereof with respect to the second component 115*b*.

In some examples, the locking ring 103 can be retained in place using the first retention mechanism 402. By retaining the locking ring 103 in place, the first retention mechanism 402 can prevent the locking ring 103 from sliding out of the set of aligned gaps, or out of the first set of slots or the second set of slots. In some examples, the first retention mechanism 402 can include a gap filler clamp that can be positioned around the first connection surface 204*a*, or a first connector, of the first component 115*a*. The first retention mechanism 402 can be positioned around the first connection surface 204*a*, or the first connector, and adjacent to the collar 220 of the locking ring 103 to physically prevent the locking ring 103 from moving such as sliding out of the set of aligned gaps, or out of the first set of slots or the second set of slots. As illustrated in FIG. 4, the first retention mechanism 402 can include an adjustment screw 404 that can be used to loosen or tighten the first retention mechanism 402. For example, the first retention mechanism 402 can be positioned around the first connector and adjacent to the collar 220, and the adjustment screw 404 can be adjusted to tighten the first retention mechanism 402 to retain the first retention mechanism 402 in place and to, by extension, retain the locking ring 103 in place.

Figure 5:
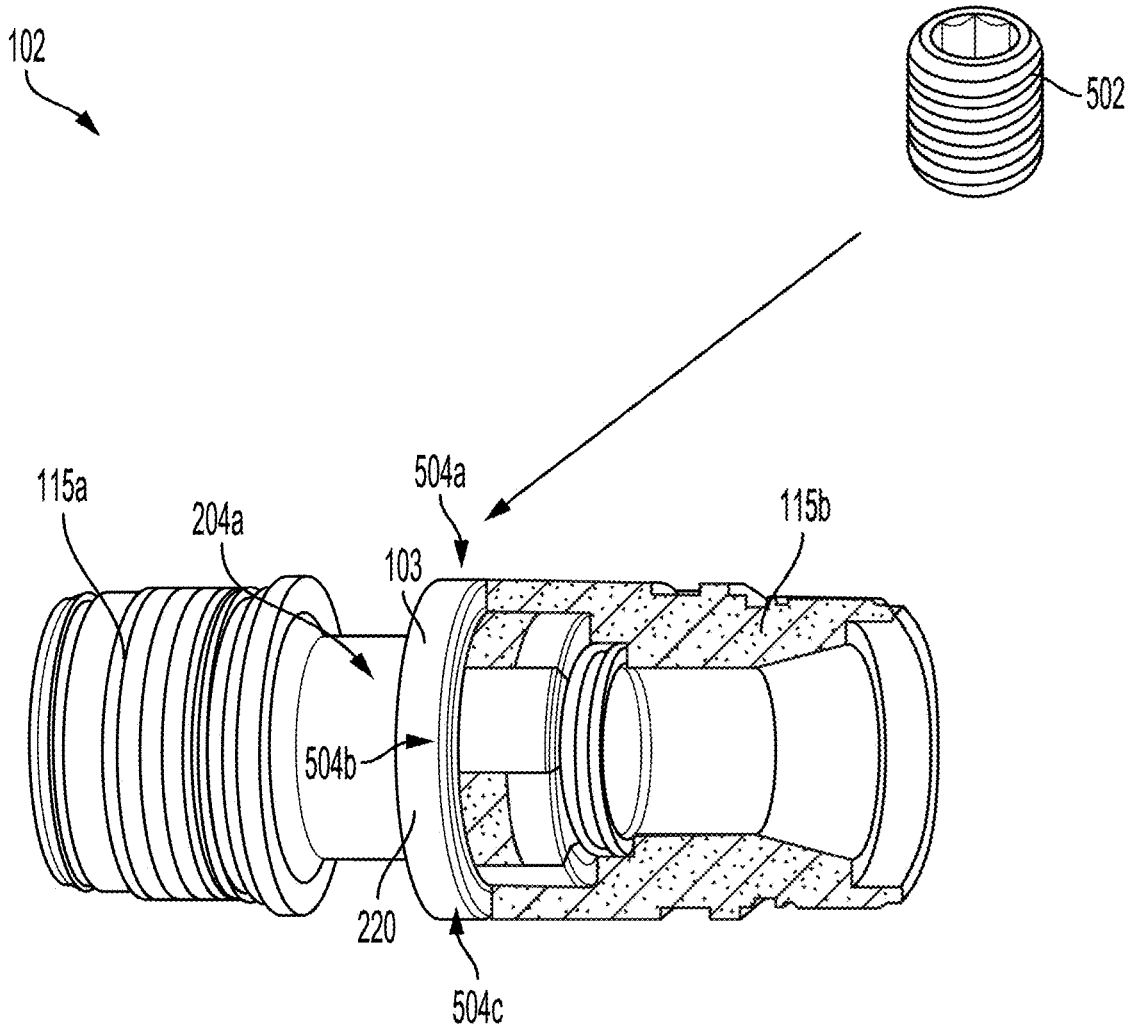
FIG. 5 is a partial sectional view of a subsystem that can include a locking ring with a second retention mechanism for coupling components of the subsystem according to some aspects of the present disclosure.

FIG. 5 is a partial sectional view of a subsystem 102 that can include a locking ring 103 with a second retention mechanism 502 for coupling components of the subsystem 102 according to some aspects of the present disclosure. As illustrated in FIG. 5, the subsystem 102 can include the first component 115*a*, the second component 115*b*, and the locking ring 103, though the subsystem 102 can include any additional, alternative, or fewer components for providing functionality for the subsystem 102. The locking ring 103 can be used to couple the first component 115*a* with the second component 115*b*. For example, the set of keys can be positioned in the set of aligned gaps, or the first set of slots or the second set of slots, to prevent the first component 115*a* from rotating, translating, or a combination thereof with respect to the second component 115*b*.

In some examples, the locking ring 103 can be retained in place using the second retention mechanism 502. By retaining the locking ring 103 in place, the second retention mechanism 502 can prevent the locking ring 103 from sliding out of the set of aligned gaps, or out of the first set of slots or the second set of slots. In some examples, the second retention mechanism 502 can include a set of screws, such as set screws, that can be positioned within a set of threaded holes distributed around the collar 220 of the locking ring 103. The set of threaded holes may be equally distributed around the collar 220 of the locking ring 103, though other arrangements for the set of threaded holes are possible for the second retention mechanism 502. For example, the set of threaded holes may include a first threaded hole positioned at a first location 504*a* on the collar 220, a second threaded hole positioned at a second location 504*b* on the collar 220, and a third threaded hole positioned at a third location 504*c* on the collar 220, though other arrangements are possible for the set of threaded holes. Each screw of the set of screws of the second retention mechanism 502, or any subset thereof, can extend through a corresponding threaded hole and through the collar 220 to engage with the first outer diameter 206*a*, or the first connection surface 204*a*, to retain the locking ring 103 in place.

Figure 6:
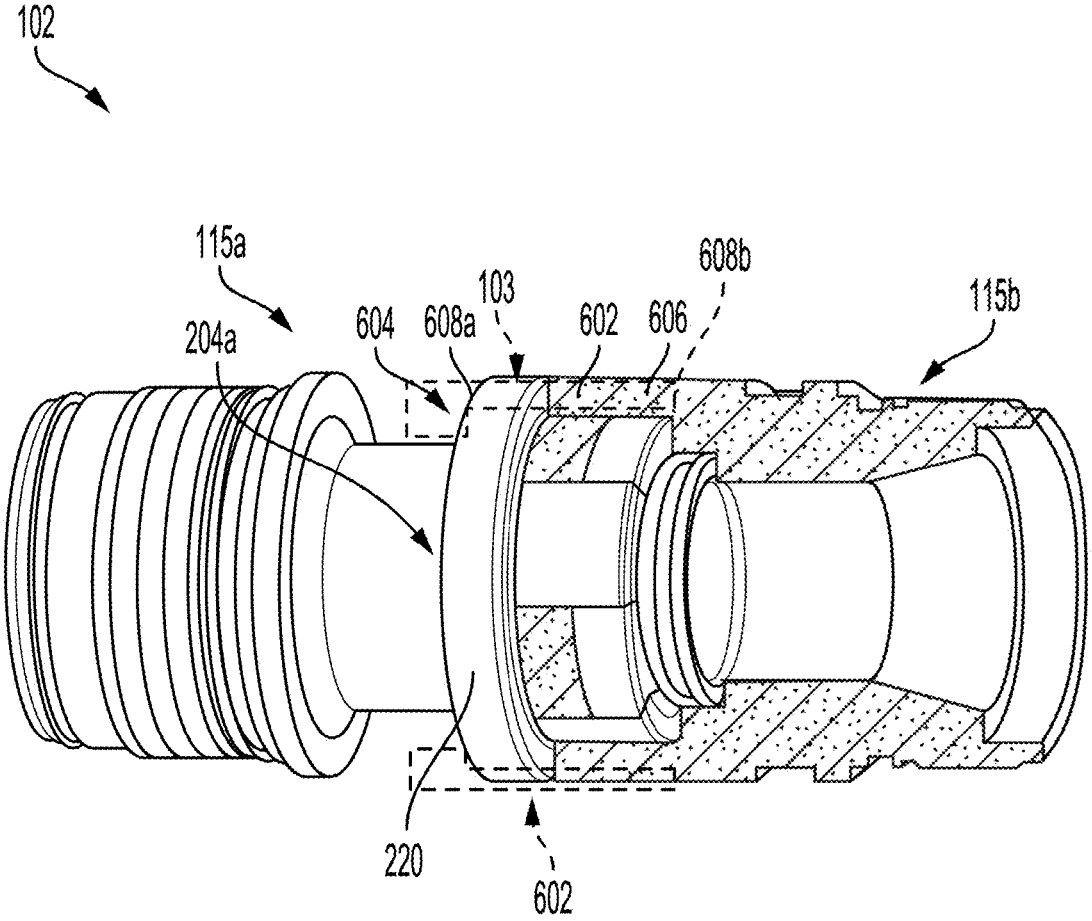
FIG. 6 is a partial sectional view of a subsystem that can include a locking ring with a third retention mechanism for coupling components of the subsystem according to some aspects of the present disclosure.

FIG. 6 is a partial sectional view of a subsystem 102 that can include a locking ring 103 with a third retention mechanism 602 for coupling components of the subsystem 102 according to some aspects of the present disclosure. As illustrated in FIG. 6, the subsystem 102 can include the first component 115*a*, the second component 115*b*, and the locking ring 103, though the subsystem 102 can include any additional, alternative, or fewer components for providing functionality for the subsystem 102. The locking ring 103 can be used to couple the first component 115*a* with the second component 115*b*. For example, the set of keys can be positioned in the set of aligned gaps, or the first set of slots or the second set of slots, to prevent the first component 115*a* from rotating, translating, or a combination thereof with respect to the second component 115*b*.

In some examples, the locking ring 103 can be retained in place using the third retention mechanism 602. By retaining the locking ring 103 in place, the third retention mechanism 602 can prevent the locking ring 103 from sliding out of the set of aligned gaps, or out of the first set of slots or the second set of slots. In some examples, the third retention mechanism 602 can include an L-bracket that can include a head 604 and a tail 606. The head 604 can be positioned around the first connection surface 204*a*, or the first connector, of the first component 115*a*. In some examples, the head can include a set of threaded holes sized to receive a set of set screws for securing the third retention mechanism 602 to the first connection surface 204*a* or other suitable portion of the first component 115*a*. Additionally or alternatively, the tail 606 may be positioned around the collar 220 of the locking ring 103 to retain the locking ring 103 in place. For example, upon securing the third retention mechanism 602 to the first connection surface 204*a* via the set of set screws, the tail 606 may apply a force to the locking ring 103 to retain the locking ring 103 in place. Additionally or alternatively, the tail 606 can be tapered from a first end 608*a* adjacent the head 604 to a second end 608*b* positionable in a corresponding slot of the first set of slots or the second set of slots. The tail 606 may be positioned in the corresponding slot via a press fit.

In some examples, the third retention mechanism 602 may be or include a threaded collar. In these examples, FIG. 6 may illustrate a sectional view of the threaded collar as the third retention mechanism 602. The threaded collar can include one or more threads on an inner diameter of the threaded collar. Additionally or alternatively, an outer diameter of the second component 115*b* can include a set of threads that can correspond with the one or more threads of the threaded collar. The set of threads can be coupled with the set of threads to cause the threaded collar to contact the locking ring 103 for retaining the locking ring 103 in place.

Figure 7:
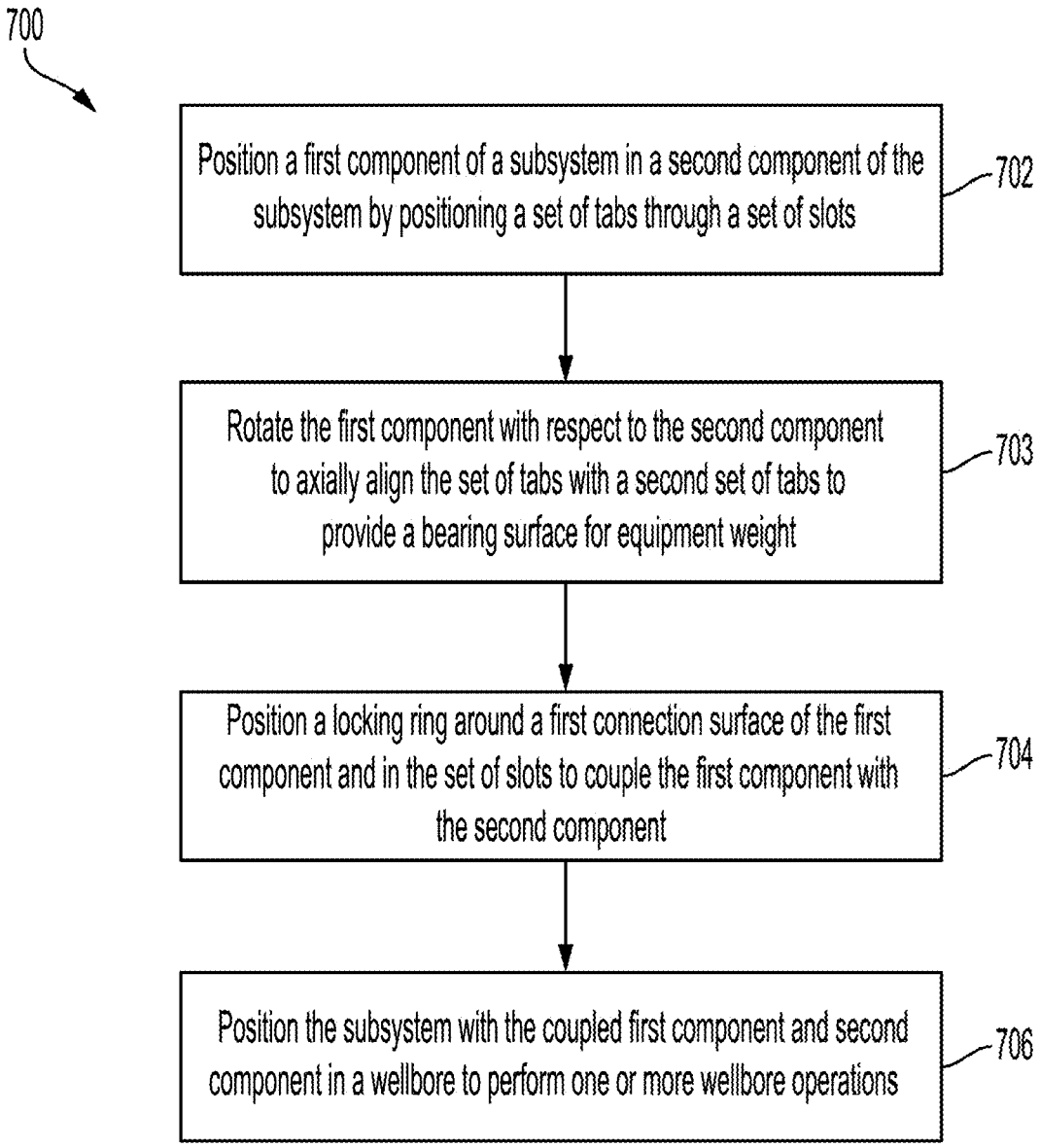
FIG. 7 is a flowchart of a process for coupling components of a subsystem using a locking ring according to some aspects of the present disclosure.

FIG. 7 is a flowchart of a process 700 for coupling components of a subsystem 102 using a locking ring 103 according to some aspects of the present disclosure. At block 702, a first component 115*a* is positioned in a second component 115*b* by positioning a first set of tabs through a second set of slots. The first component 115*a* can include the first set of tabs that can extend to a first outer diameter that is larger than a second outer diameter of the first connection surface 204*a* of the first component 115*a*. Additionally or alternatively, the second component can include the second set of tabs and the second set of slots that can extend to a first inner diameter that is larger than a second inner diameter of the second connection surface 204*b* of the second component 115*b*.

At block 703, the first component 115*a* is rotated relative to the second component 115*b* to cause the first set of tabs to be axially aligned with a second set of tabs. In some examples, the first set of tabs being axially aligned with the second set of tabs can involve the first set of tabs being at least partially misaligned with the second set of slots to cause the first set of tabs to contact an inner surface 302 of the second connection surface 204*b*, or of corresponding tabs of the second set of tabs, to provide axial support to the subsystem 102. By the first set of tabs contacting the second set of tabs, a bearing surface can be formed, and the bearing surface may support the weight associated with equipment for the well system 100.

At block 704, the locking ring 103 is positioned around the first connection surface 204*a* and in the first set of slots or the second set of slots to couple the first component 115*a* with the second component 115*b*. In some examples, the locking ring 103 can be positioned in the set of aligned gaps formed by positioning the first component 115*a* in the second component 115*b* and rotating the first component 115*a* relative to the second component 115*b*. The locking ring 103 can include a collar 220 that can be positioned around the first connection surface 204*a* and a set of keys, which may include the first key 222*a*, the second key 222*b*, and the third key 222*c*. The set of keys can be positioned in the set of aligned gaps, or in the first set of slots or the second set of slots, to couple the first component 115*a* with the second component 115*b*. In some examples, coupling the first component 115*a* with the second component 115*b* can involve retaining a relative position and orientation between the first component 115*a* and the second component 115*b*. That is, when the locking ring 103 is engaged with the set of aligned gaps, the first component 115*a* may not be able to rotate, translate, or a combination thereof relative to the second component 115*b*, or vice versa.

At block 706, the subsystem 102 is positioned in a wellbore such as the wellbore 108. By positioning the subsystem 102 in the wellbore, the first component 115*a*, the second component 115*b*, and the locking ring 103 can be positioned in the wellbore 108, and the first component 115*a* can remain coupled with the second component 115*b* via the locking ring 103 after being positioned in the wellbore 108. The subsystem 102 can be used to perform one or more wellbore operations in the wellbore 108. For example, such as in examples in which the subsystem 102 is, or is included in, an electric submersible pump, the subsystem 102 can facilitate or otherwise be used to perform an artificial lift operation. Other suitable wellbore operations are possible to perform using the subsystem 102.

Figure 8:
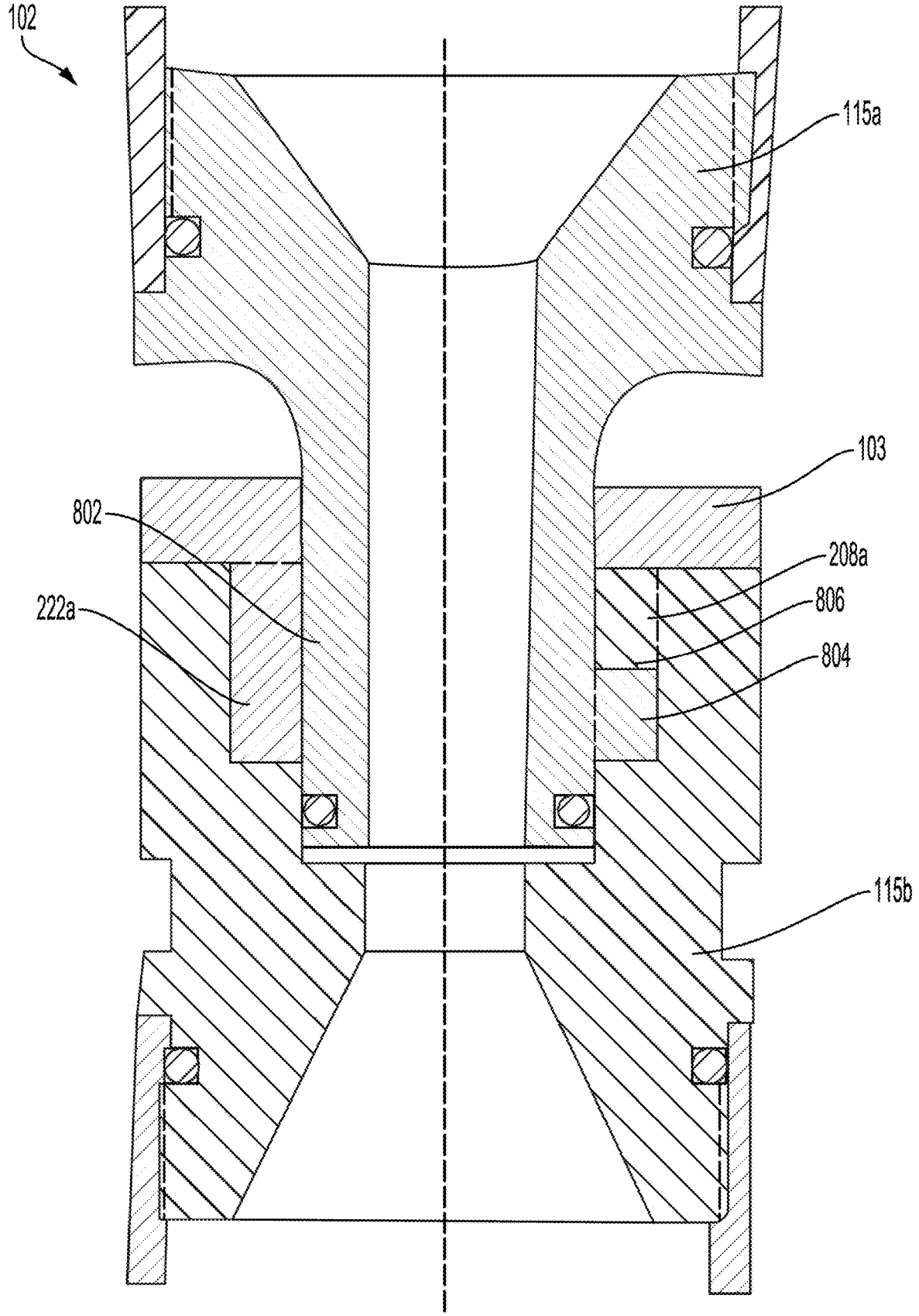
FIG. 8 is a sectional view of a subsystem that can include a locking ring for coupling components of the subsystem according to some aspects of the present disclosure.

FIG. 8 is a sectional view of a subsystem 102 that can include a locking ring 103 for coupling components of the subsystem 102 according to some aspects of the present disclosure. As illustrated in FIG. 8, the subsystem 102 can include the first component 115*a*, the second component 115*b*, and the locking ring 103. The first component 115*a* may be coupled with the second component 115*b* by engaging the locking ring 103. In some examples, engaging the locking ring 103 can involve positioning the set of keys, which can include the first key 222*a*, of the locking ring 103 in the set of aligned gaps, such as aligned gap 802, formed by axially aligning the first set of tabs of the first component 115*a* with the second set of tabs of the second component 115*b* while the first component 115*a* is positioned in the second component 115*b*. As illustrated in FIG. 8, the first tab 208*a* can be aligned with a separate tab 804 of the second component 115*b* to form a bearing surface 806 to support weight of equipment associated with the subsystem 102.

In some aspects, systems and methods for a locking ring for coupling components of a subsystem in a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a first component of a subsystem positionable in a wellbore, the first component comprising: a first connector having a first outer diameter; and a first set of tabs that extend to a second outer diameter that is larger than the first outer diameter, the first set of tabs comprising at least one tab; and a first set of slots arranged along a circumference of the first outer diameter, the first set of slots comprising at least one slot; a second component of the subsystem, the second component comprising: a second connector couplable with the first connector, the second connector having a first inner diameter; and a second set of tabs that extend to a second inner diameter that is smaller than the first inner diameter, the second set of tabs comprising at least one tab; and a second set of slots arranged along a circumference of the first inner diameter, the second set of slots comprising at least one slot, wherein the first component is insertable into the second component by aligning the first set of tabs with the second set of slots, and wherein the first component is rotatable with respect to the second component to axially align the first set of tabs with the second set of tabs and to align the first set of slots and the second set of slots; and a locking ring positionable around the first connector and insertable into the first set of slots or the second set of slots to rotationally couple the first component and the second component to prevent relative rotational movement between the first component and the second component.

Example 2 is the system of example 1, wherein when the first set of tabs are axially aligned with the second set of tabs, a set of aligned gaps formed by the first set of slots and the second set of slots are accessible, wherein the locking ring comprises a set of keys extending from a collar positionable around the first connector, and wherein each key of the set of keys is sized to be positioned in a corresponding aligned gap of the set of aligned gaps.

Example 3 is the system of example 1, further comprising a retention mechanism couplable with the locking ring to retain the locking ring in place axially, wherein the retention mechanism comprises a set of screws positionable within a set of threaded holes distributable around a collar of the locking ring, and wherein each screw of the set of screws is arranged to extend through the collar of the locking ring to engage with the first outer diameter of the first connector to retain the locking ring in place.

Example 4 is the system of example 1, further comprising a retention mechanism couplable with the locking ring to retain the locking ring in place, wherein the retention mechanism comprises a gap filler clamp positionable around the first connector and adjacent to the locking ring to prevent axial movement of the locking ring.

Example 5 is the system of example 1, further comprising a retention mechanism couplable with the locking ring to retain the locking ring in place, wherein the retention mechanism comprises an L-bracket that comprises: a head positionable around the first connector, the head comprising a set of threaded holes sized to receive a set of set screws for securing the L-bracket on the first connector; and a tail positionable around a collar of the locking ring to retain the locking ring in place in the second connector.

Example 6 is the system of example 5, wherein the tail is tapered from a first end adjacent the head to a second end positionable in a corresponding slot of the first set of slots or the second set of slots, and wherein the tail is positionable in the corresponding slot via a press fit.

Example 7 is the system of example 1, further comprising a retention mechanism couplable with the locking ring to retain the locking ring in place, wherein the retention mechanism comprises a threaded collar that is threaded on an inner diameter of the threaded collar, wherein an outer diameter of the second component includes a set of threads corresponding with a second set of threads of the threaded collar, and wherein the set of threads are couplable with the second set of threads to cause the threaded collar to contact the locking ring to retain the locking ring in place.

Example 8 is a system comprising: a first component of a subsystem positionable in a wellbore, the first component comprising a first set of tabs that extend to a first outer diameter that is larger than a second outer diameter of a first connection surface of the first component; a second component of the subsystem, the second component comprising a second set of tabs that extend to a first inner diameter that is smaller than a second inner diameter of a second connection surface of the second component, the first set of tabs arranged to be positioned through slots formed by the second set of tabs and to be rotated to position the first set of tabs axially aligned with the second set of tabs to prevent relative rotation between the first component into the second component; and a locking ring positionable around the first connection surface and insertable into the slots to couple the first component and the second component, the locking ring comprising a collar positionable around the first connection surface and a set of keys extending from the collar.

Example 9 is the system of example 8, further comprising a retention mechanism couplable with the locking ring to retain the locking ring in place, wherein the retention mechanism comprises a set of screws positionable within a set of threaded holes distributable around the collar, and wherein each screw of the set of screws is arranged to extend through the collar to engage with the first outer diameter to retain the locking ring in place.

Example 10 is the system of example 8, further comprising a retention mechanism couplable with the locking ring to retain the locking ring in place, wherein the retention mechanism comprises a gap filler clamp positionable around the first connection surface and adjacent to the locking ring to prevent axial movement of the locking ring.

Example 11 is the system of example 8, further comprising a retention mechanism couplable with the locking ring to retain the locking ring in place, wherein the retention mechanism comprises an L-bracket that comprises: a head positionable around the first connection surface, the head comprising a set of threaded holes sized to receive a set of set screws for securing the L-bracket on the first connection surface; and a tail positionable around the collar to retain the locking ring in place.

Example 12 is the system of example 11, wherein the tail is tapered from a first end adjacent the head to a second end positionable in a corresponding slot of the slots, and wherein the tail is positionable in the corresponding slot via a press fit.

Example 13 is the system of example 8, further comprising a retention mechanism couplable with the locking ring to retain the locking ring in place, wherein the retention mechanism comprises a threaded collar that is threaded on an inner diameter of the threaded collar, wherein an outer diameter of the second component includes a set of threads corresponding with a second set of threads of the threaded collar, and wherein the set of threads are couplable with the second set of threads to cause the threaded collar to contact the locking ring to retain the locking ring in place.

Example 14 is the system of example 8, wherein when the first set of tabs are axially aligned with the second set of tabs, a set of aligned gaps are accessible, and wherein each key of the set of keys is sized to be positioned in a corresponding aligned gap of the set of aligned gaps.

Example 15 is a method comprising: positioning a first component in a second component by positioning a first set of tabs through a set of slots formed by a second set of tabs and rotating the first component relative to the second component to cause the first set of tabs to be axially aligned with the second set of tabs, wherein: the first component comprises the first set of tabs that extend to a first outer diameter that is larger than a second outer diameter of a first connection surface of the first component; and the second component comprises the second set of tabs that extend to a first inner diameter that is smaller than a second inner diameter of a second connection surface of the second component; positioning a locking ring around the first connection surface and in the set of slots to prevent relative rotation between the first component and the second component; and positioning a subsystem comprising the first component, the second component, and the locking ring in a wellbore to perform one or more wellbore operations using the subsystem.

Example 16 is the method of example 15, further comprising coupling a retention mechanism with the locking ring to retain the locking ring in place, wherein the retention mechanism comprises a set of screws positionable within a set of threaded holes distributed around a collar of the locking ring, and wherein each screw of the set of screws is arranged to extend through the collar of the locking ring to engage with the first outer diameter to retain the locking ring in place.

Example 17 is the method of example 15, further comprising coupling a retention mechanism with the locking ring to retain the locking ring in place, wherein the retention mechanism comprises a gap filler clamp positioned around the first connection surface and adjacent to the locking ring to prevent axial movement of the locking ring.

Example 18 is the method of example 15, further comprising coupling a retention mechanism with the locking ring to retain the locking ring in place, wherein the retention mechanism comprises an L-bracket that comprises: a head positioned around the first connection surface, the head comprising a set of threaded holes sized to receive a set of set screws for securing the L-bracket on the first connection surface; and a tail positioned around a collar of the locking ring to retain the locking ring in place, wherein the tail is tapered from a first end adjacent the head to a second end positioned in a corresponding slot of the set of slots, and wherein the tail is positioned in the corresponding slot via a press fit.

Example 19 is the method of example 15, further comprising coupling a retention mechanism with the locking ring to retain the locking ring in place, wherein the retention mechanism comprises a threaded collar that is threaded on an inner diameter of the threaded collar, wherein an outer diameter of the second component includes a set of threads corresponding with a second set of threads of the threaded collar, and wherein the set of threads are coupled with the second set of threads to cause the threaded collar to contact the locking ring to retain the locking ring in place.

Example 20 is the method of example 15, wherein when the first set of tabs are axially aligned with the second set of tabs, a set of aligned gaps are accessible, and wherein each key of a set of keys of the locking ring is positioned in a corresponding aligned gap of the set of aligned gaps.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a first component of a subsystem positionable in a wellbore, the first component comprising:

a first connector having a first outer diameter;

a first set of tabs that extend in a first direction to a second outer diameter that is larger than the first outer diameter, the first set of tabs comprising at least one tab, and each tab of the first set of tabs extending, in a second direction orthogonal to the first direction, along the second outer diameter from a first point to a second point; and a first set of slots arranged along a circumference of the first outer diameter, the first set of slots comprising at least one slot;

a second component of the subsystem, the second component comprising:

a second connector couplable with the first connector, the second connector having a first inner diameter;

a second set of tabs that extend, in a third direction opposite the first direction, to a second inner diameter that is smaller than the first inner diameter, the second set of tabs comprising at least one tab, and each tab of the second set of tabs extending, in the second direction that is orthogonal to the third direction, along the second inner diameter from a third point to a fourth point; and a second set of slots arranged along a circumference of the first inner diameter, the second set of slots comprising at least one slot, wherein the first component is insertable into the second component by aligning the first set of tabs with the second set of slots, wherein the first component is rotatable with respect to the second component to axially align the first set of tabs with the second set of tabs and to align the first set of slots and the second set of slots, and wherein, when the first set of tabs is aligned with the second set of tabs, a first tab from the first set of tabs is aligned with a second tab of the second set of tabs along a line that extends from the first point to the fourth point; and a locking ring positionable around the first connector and insertable into the first set of slots and the second set of slots to rotationally couple the first component and the second component to prevent relative rotational movement between the first component and the second component, the locking ring comprising a key slidably insertable into the first set of slots and the second set of slots to extend from the first point to the fourth point.

2. The system of claim 1, wherein when the first set of tabs are axially aligned with the second set of tabs, a set of aligned gaps formed by the first set of slots and the second set of slots are accessible, wherein the locking ring comprises a set of keys that includes the key, wherein the set of keys extends from a collar positionable around the first connector, and wherein each key of the set of keys is sized to be positioned in a corresponding aligned gap of the set of aligned gaps.

3. The system of claim 1, further comprising a retention mechanism couplable with the locking ring to retain the locking ring in place axially, wherein the retention mechanism comprises a set of screws positionable within a set of threaded holes distributable around a collar of the locking ring, and wherein each screw of the set of screws is arranged to extend through the collar of the locking ring to engage with the first outer diameter of the first connector to retain the locking ring in place.

4. The system of claim 1, further comprising a retention mechanism couplable with the locking ring to retain the locking ring in place, wherein the retention mechanism comprises a gap filler clamp positionable around the first connector and adjacent to the locking ring to prevent axial movement of the locking ring.

5. The system of claim 1, further comprising a retention mechanism couplable with the locking ring to retain the locking ring in place, wherein the retention mechanism comprises an L-bracket that comprises:

a head positionable around the first connector, the head comprising a set of threaded holes sized to receive a set of set screws for securing the L-bracket on the first connector; and a tail positionable around a collar of the locking ring to retain the locking ring in place in the second connector.

6. The system of claim 5, wherein the tail is tapered from a first end adjacent the head to a second end positionable in a corresponding slot of the first set of slots or the second set of slots, and wherein the tail is positionable in the corresponding slot via a press fit.

7. The system of claim 1, further comprising a retention mechanism couplable with the locking ring to retain the locking ring in place, wherein the retention mechanism comprises a threaded collar that is threaded on an inner diameter of the threaded collar, wherein an outer diameter of the second component includes a set of threads corresponding with a second set of threads of the threaded collar, and wherein the set of threads are couplable with the second set of threads to cause the threaded collar to contact the locking ring to retain the locking ring in place.

8. A system comprising:

a first component of a subsystem positionable in a wellbore, the first component comprising a first set of tabs that extend in a first direction to a first outer diameter that is larger than a second outer diameter of a first connection surface of the first component, and each tab of the first set of tabs extending, in a second direction orthogonal to the first direction, along the second outer diameter from a first point to a second point;

a second component of the subsystem, the second component comprising a second set of tabs that extend, in a third direction opposite the first direction, to a first inner diameter that is smaller than a second inner diameter of a second connection surface of the second component, the first set of tabs arranged to be positioned through slots formed by the second set of tabs and to be rotated to position the first set of tabs axially aligned with the second set of tabs to prevent relative rotation between the first component into the second component, and each tab of the second set of tabs extending, in the second direction that is orthogonal to the third direction, along the second inner diameter from a third point to a fourth point; and a locking ring positionable around the first connection surface and insertable into the slots to couple the first component and the second component, the locking ring comprising a collar positionable around the first connection surface and a set of keys extending from the collar, and the locking ring comprising a key of the set of keys slidably insertable around the first set of tabs and the second set of tabs to extend from the first point to the fourth point.

9. The system of claim 8, further comprising a retention mechanism couplable with the locking ring to retain the locking ring in place, wherein the retention mechanism comprises a set of screws positionable within a set of threaded holes distributable around the collar, and wherein each screw of the set of screws is arranged to extend through the collar to engage with the first outer diameter to retain the locking ring in place.

10. The system of claim 8, further comprising a retention mechanism couplable with the locking ring to retain the locking ring in place, wherein the retention mechanism comprises a gap filler clamp positionable around the first connection surface and adjacent to the locking ring to prevent axial movement of the locking ring.

11. The system of claim 8, further comprising a retention mechanism couplable with the locking ring to retain the locking ring in place, wherein the retention mechanism comprises an L-bracket that comprises:

a head positionable around the first connection surface, the head comprising a set of threaded holes sized to receive a set of set screws for securing the L-bracket on the first connection surface; and a tail positionable around the collar to retain the locking ring in place.

12. The system of claim 11, wherein the tail is tapered from a first end adjacent the head to a second end positionable in a corresponding slot of the slots, and wherein the tail is positionable in the corresponding slot via a press fit.

13. The system of claim 8, further comprising a retention mechanism couplable with the locking ring to retain the locking ring in place, wherein the retention mechanism comprises a threaded collar that is threaded on an inner diameter of the threaded collar, wherein an outer diameter of the second component includes a set of threads corresponding with a second set of threads of the threaded collar, and wherein the set of threads are couplable with the second set of threads to cause the threaded collar to contact the locking ring to retain the locking ring in place.

14. The system of claim 8, wherein when the first set of tabs are axially aligned with the second set of tabs, a set of aligned gaps are accessible, and wherein each key of the set of keys is sized to be positioned in a corresponding aligned gap of the set of aligned gaps.

15. A method comprising:

positioning a first component in a second component by positioning a first set of tabs through a set of slots formed by a second set of tabs and rotating the first component relative to the second component to cause the first set of tabs to be axially aligned with the second set of tabs, wherein:

the first component comprises the first set of tabs that extend in a first direction to a first outer diameter that is larger than a second outer diameter of a first connection surface of the first component, and each tab of the first set of tabs extending, in a second direction orthogonal to the first direction, along the second outer diameter from a first point to a second point; and the second component comprises the second set of tabs that extend, in a third direction opposite the first direction, to a first inner diameter that is smaller than a second inner diameter of a second connection surface of the second component, each tab of the second set of tabs extending, in the second direction that is orthogonal to the third direction, along the second inner diameter from a third point to a fourth point;

positioning a locking ring around the first connection surface and in the set of slots to prevent relative rotation between the first component and the second component, the locking ring comprising a key slidably insertable around the first set of tabs and the second set of tabs to extend from the first point to the fourth point; and positioning a subsystem comprising the first component, the second component, and the locking ring in a wellbore to perform one or more wellbore operations using the subsystem.

16. The method of claim 15, further comprising coupling a retention mechanism with the locking ring to retain the locking ring in place, wherein the retention mechanism comprises a set of screws positionable within a set of threaded holes distributed around a collar of the locking ring, and wherein each screw of the set of screws is arranged to extend through the collar of the locking ring to engage with the first outer diameter to retain the locking ring in place.

17. The method of claim 15, further comprising coupling a retention mechanism with the locking ring to retain the locking ring in place, wherein the retention mechanism comprises a gap filler clamp positioned around the first connection surface and adjacent to the locking ring to prevent axial movement of the locking ring.

18. The method of claim 15, further comprising coupling a retention mechanism with the locking ring to retain the locking ring in place, wherein the retention mechanism comprises an L-bracket that comprises:

a head positioned around the first connection surface, the head comprising a set of threaded holes sized to receive a set of set screws for securing the L-bracket on the first connection surface; and a tail positioned around a collar of the locking ring to retain the locking ring in place, wherein the tail is tapered from a first end adjacent the head to a second end positioned in a corresponding slot of the set of slots, and wherein the tail is positioned in the corresponding slot via a press fit.

19. The method of claim 15, further comprising coupling a retention mechanism with the locking ring to retain the locking ring in place, wherein the retention mechanism comprises a threaded collar that is threaded on an inner diameter of the threaded collar, wherein an outer diameter of the second component includes a set of threads corresponding with a second set of threads of the threaded collar, and wherein the set of threads are coupled with the second set of threads to cause the threaded collar to contact the locking ring to retain the locking ring in place.

20. The method of claim 15, wherein the key is included in a set of keys, wherein when the first set of tabs are axially aligned with the second set of tabs, a set of aligned gaps are accessible, and wherein each key of the set of keys of the locking ring is positioned in a corresponding aligned gap of the set of aligned gaps.

* * * * *